US006895786B2

(12) United States Patent
Zorini et al.

(10) Patent No.: US 6,895,786 B2
(45) Date of Patent: May 24, 2005

(54) CONTROL DEVICE FOR TEXTILE MACHINES, IN PARTICULAR FOR CROCHET MACHINES

(75) Inventors: Luigi Omodeo Zorini, Via dei Mille, 71, 27024 Cilavegna (Pavia) (IT); Pierantonio Franchino, Pavia (IT)

(73) Assignee: Luigi Omodeo Zorini, Cilavegna (IT)

( * ) Notice: Subject to any disclaimer, the term of this patent is extended or adjusted under 35 U.S.C. 154(b) by 0 days.

(21) Appl. No.: 10/965,476

(22) Filed: Oct. 14, 2004

(65) Prior Publication Data

US 2005/0081567 A1 Apr. 21, 2005

(30) Foreign Application Priority Data

Oct. 21, 2003 (EP) ..... 03425676

(51) Int. Cl.[7] ..... D04B 27/20
(52) U.S. Cl. ..... 66/207
(58) Field of Search ..... 66/204, 205, 206, 66/207, 208

(56) References Cited

U.S. PATENT DOCUMENTS 4,761,973 A 8/1988 Gangi
4,989,423 A 2/1991 Schafer
5,307,648 A 5/1994 Forkert et al.
5,502,987 A * 4/1996 Zorini ..... 66/207
5,862,683 A * 1/1999 Otobe et al. ..... 66/207

FOREIGN PATENT DOCUMENTS

| | | |
|---|---|---|
| DE | 2257224 | 5/1974 |
| EP | 0684331 A1 | 11/1995 |
| EP | 0708190 A2 | 4/1996 |
| EP | 1013812 A1 | 6/2000 |

* cited by examiner

*Primary Examiner*—Danny Worrell
(74) *Attorney, Agent, or Firm*—Pearne & Gordon LLP

(57) ABSTRACT

A control device for textile machines, in particular for crochet machines, comprising an electric motor (10) having an output shaft (11) drivable in rotation and a first reduction gear (12) interposed between the output shaft (11) and a knitting member (13) of a textile machine. The device (1) further comprises drive means (14) to power and control the motor (10), and detecting means (15) to detect a main parameter (100) representative of a position of the knitting member (13) and to generate a corresponding main signal (110); said main signal incorporates the main parameter (100) and is destined to the drive means (14) regulating power supply to the motor (10) depending on the main parameter (100).

13 Claims, 2 Drawing Sheets

CONTROL DEVICE FOR TEXTILE MACHINES, IN PARTICULAR FOR CROCHET MACHINES

FIELD AND BACKGROUND OF THE INVENTION

The present invention relates to a control device for textile machines, in particular for crochet machines.

It is known that crochet machines comprise a needle bar bearing a plurality of needles, a guide bar bearing a plurality of eye-pointed needles and at least one carrier slide bar bearing a predetermined number of threading tubes. These bars cooperate with each other carrying out synchronized movements for manufacturing fabrics and textile products in general.

To move the different members composing said crochet machines and in particular the carrier slide bars, some of the most advanced crochet machines are equipped with suitably-operated electric motors with which rotary encoders are generally associated; each encoder has the task of detecting the angular position of the output shaft of a corresponding motor and communicate this data to the machine control system, so as to enable correct regulation of the movement of the different members through the respective motors.

Generally, each motor is capable of moving the respective member by making its output shaft carry out rotations of less than 360°; in other words, through rotations that do not reach a full revolution, each output shaft succeeds in moving the knitting member interlocked therewith to all the required positions.

In order to improve movement accuracy and reliability of the different members, reduction gears have been inserted between the output shaft of the motor and the corresponding knitting member; therefore, to bring the knitting member from an extremity to the other of its stroke, the shaft of each motor must carry out several revolutions.

However, some operating drawbacks are connected with the manufacturing choice briefly described above.

In fact, the encoder associated with each motor is a simple absolute single-revolution encoder, i.e. capable of only detecting the angular position of the output shaft, without recognizing to which revolution such a position corresponds; in other words, by said encoders currently mounted on the motors present in crochet machines, it is possible to known the angular position of the shaft with reference to a single revolution (i.e. a value included between 0° and 360°), even if the true movement of the shaft can be performed in several revolutions (in the case of five revolutions, there is an overall value of possible 1800° rotation) for a single movement of the member associated therewith.

Therefore, when at the moment of turning the machine off the weft bars are required to be manually shifted (for carrying out maintenance or cleaning operations, for example), the information concerning the true position of these bars—i.e. the absolute position of the output shaft of the corresponding motor—is lost, because the only available detecting instrument is said single-revolution encoder that is not able to supply a correct information relating to displacements of some importance (corresponding to rotations exceeding 360° of the output shaft of the corresponding motor) occurred during the machine deactivation.

Consequently, upon restarting of the machine, when the weft bars are moved in accordance with the program inputted to the respective drive means, serious damages may occur both to possible semifinished products in engagement with the machine members and to the devices of the machine itself; in fact, since the drive means is not acquainted with the exact position of the members to be moved, it can impose movements to the bars that are beyond the end positions allowed to them or movements submitting the weft yarns to too strong tensions causing breaking of the yarns.

To remedy this drawback, the known art has only supplied solutions preventing the machine members, and in particular the weft bars, from moving when the machine is turned off; these solutions typically involve mechanical, magnetic or electromagnetic brakes that are active on the bars, or kinematic connecting mechanisms of the screw-nut screw type.

It is however apparent that technical solutions as those described above prevent a regular execution of the maintenance and cleaning operations on the machine, and therefore they do not meet the operators' requirements in the concerned technical field.

SUMMARY OF THE INVENTION

The present invention therefore aims at providing a control device for textile machines, in particular crochet machines, capable of solving the above mentioned drawbacks.

In particular it is an aim of the present invention to make available a control device for textile machines allowing knitting members of the machine to be moved when the latter is deactivated and the fabric production to be correctly resumed on restarting of the machine.

It is a further aim of the invention to provided a control device allowing maintenance and cleaning operations to be carried out on the machine when the latter is turned off, without causing failures or damages to the machine itself when production is resumed.

The foregoing and further aims are substantially achieved by a control device for textile machines, in particular crochet machines, having the features set out in the appended claims.

BRIEF DESCRIPTION OF THE DRAWINGS

Further features and advantages will become more apparent from the detailed description of a preferred, but not exclusive, embodiment of a control device in accordance with the present invention.

This description will be set out hereinafter with reference to the accompanying drawings, given by way of non-limiting example, in which.

DESCRIPTION OF THE PREFERRED EMBODIMENT

Figure 1:
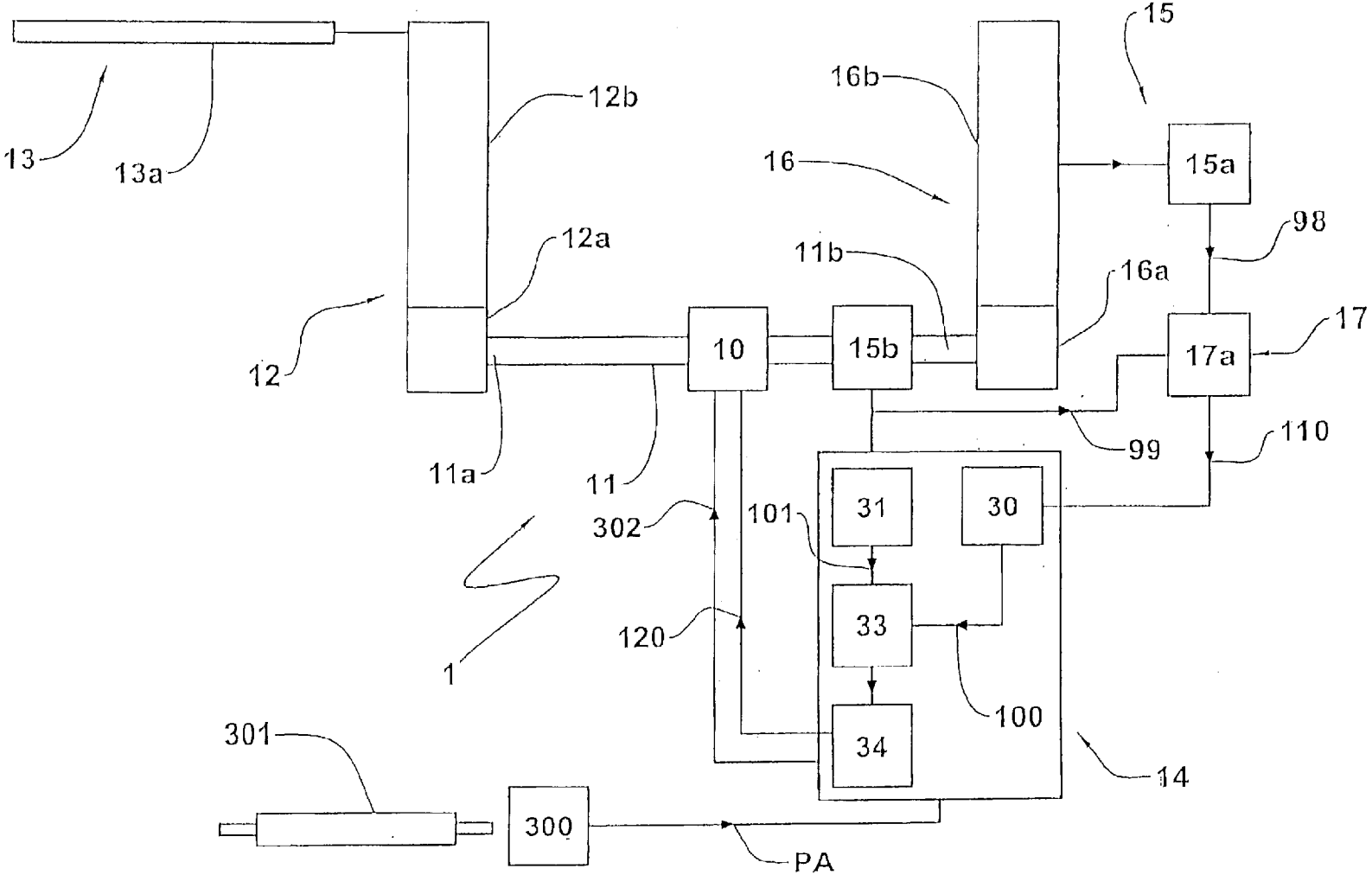
FIG. 1 is a block diagram of a control device in accordance with the present invention.
Figure 2:
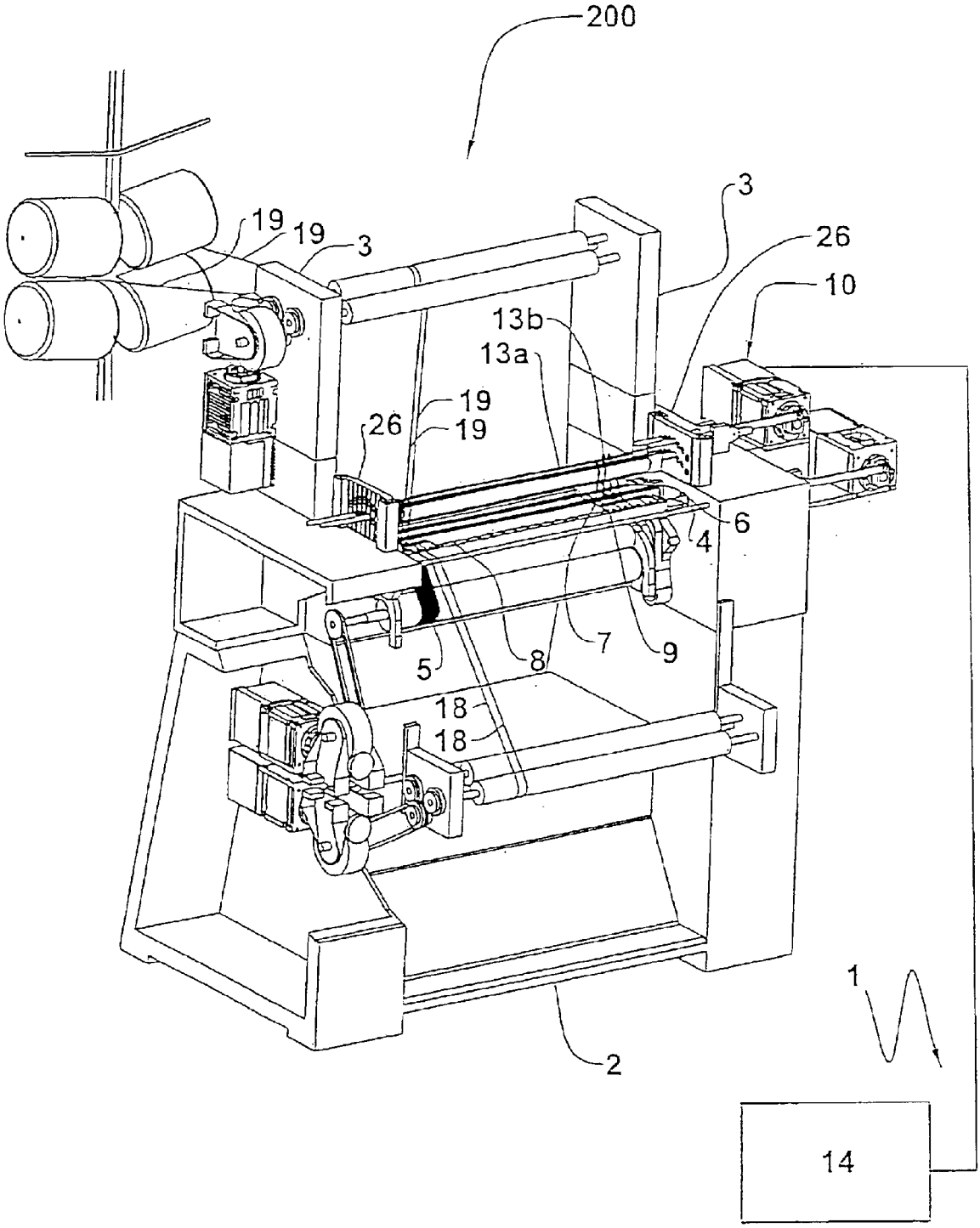
FIG. 2 diagrammatically shows a textile machine associated with the device in FIG. 1.

With reference to the drawings, the control device for textile machines, in particular crochet machines, is generally denoted at 1.

The control device 1 is preferably associated with a textile machine 200, of the crochet type for warp knitting workings, comprising a bed 2 provided with two side standards 3, between which at least one front grooved bar 4 horizontally extends, at which sequential interlacing of the knitting yarns takes place for manufacture of a textile product 5.

Also arranged between the side standards 3 is a needle bar 6 supporting a plurality of needles 7.

The needle bar 6 carries out movement of needles 7 along a direction substantially parallel to the longitudinal extension of said needles and perpendicular to the extension of the front grooved bar 4.

Also mounted between the side standards 3 is a warp yarn guide bar or more simply "guide bar" 8 bearing a plurality of eye-pointed needles 9 and actuating the latter along arched trajectories, on either side of needles 7, in a direction perpendicular to the longitudinal extension of the needles 7 themselves, to obtain warp chains of said textile product 5.

The warp yarns 18, each of which is in engagement with a respective eye-pointed needle 9, are wound around a beam from which they are progressively unwound during manufacture of the textile product 5.

The textile machine 200 further comprises at least one carrier slide bar 13*a*, on which a plurality of threading tubes 13*b* are mounted; the carrier slide bar 13*a* is submitted both to a reciprocating motion in a vertical direction through appropriate lifting plates 26 with which the ends of said carrier slide bar 13*a* are in engagement, and to a horizontal movement in a direction substantially parallel to its longitudinal extension.

In this way, the weft yarns 19 guided by said threading tubes 13*b* are interlooped with the warp chains obtained through a mutual motion of the needles 7 and eye-pointed needles 9, thereby making the textile product 5.

The structure and operation of a textile machine of the crochet type are described in detail in patents EP0708190, EP0684331 and EP 1013812 herein incorporated by reference.

In addition to the above, it is to be noted that the textile machine 200 is further provided with a main shaft 301, the position and rotation speed of which are taken as a reference for the synchronized movement of the above mentioned knitting members; in particular this synchronization can be obtained electronically: an auxiliary sensor 300, preferably an encoder, detects the angular position PA of said main shaft 301.

This information, together with a follow-up ratio suitably calculated by a controller, is transmitted to the actuators designed to move said members, so as to regulate movements thereof according to preset programs; the angular position PA is in fact sent to drive means 14 that will generate, depending on said parameter PA and said preset programs stored in memory 31, a synchronism signal 302 destined to motor 10 (better described in the following) in order to enable correct movement of the knitting member 13 interlocked with such a motor 10.

Consequently use of cam chains (or glider chains) to transmit motion from the main shaft to the knitting members can be avoided; in other words, the system consisting of the encoder, controller and several actuators, carries out an emulation of the electronic type, of a traditional kinematic transmission mechanism of the mechanical type.

By virtue of the hitherto described features, important advantages are achieved taking into account the requirement of synchronizing the different members in a precise manner on activation of the machine 200; in fact, a control of the electronic type allows each member to be moved with the greatest accuracy in accordance with the preset work programs.

In particular the above mentioned advantages are well apparent with reference to a "multi-revolution" operating technique, in which the actuator output shaft for movement of the weft bar, in order to shift the bar itself between the end positions of the bar stroke, carries out rotations exceeding 360°.

In order to move the different members of the machine 200, and in particular the carrier slide bar 13*a* according to a preset program, the textile machine 200 is connected with the control device 1 to be described in detail hereinafter.

The control device 1 (FIG. 1) first of all comprises an electric motor 10 that can preferably be a brushless motor.

Motor 10 is equipped with an output shaft 11, in engagement at a first end 11*a* thereof with a first reduction gear 12; the latter has a first rotation element 12*a* mounted on the output shaft 11, and a second rotation element 12*b* in engagement with the first rotation element 12*a*.

The rotation elements 12*a*, 12*b* can be gear wheels mutually in engagement, for example; alternatively, they can be two pulleys connected with each other by a driving belt.

Generally, the second rotation element 12*b* has a greater diameter than the first rotation element 12*a*; the ratio between the diameter of the first reduction element 12*a* and the diameter of the second reduction element 12*b* defines the reduction ratio of the first reduction gear 12.

The second rotation element 12*a* is connected with a knitting member 13 of the textile machine 200; this knitting member 13 is preferably a carrier slide bar 13*a* of the textile machine 200 itself.

The carrier slide bar 13*a* is moved by the second rotation element 12*b* (by a connecting rod-crank driving mechanism, for example) in a direction substantially parallel to the longitudinal extension of the bar 13*a* itself, between a first and a second positions. The first and second positions of bar 13*a* are the end positions that the bar 13*a* itself can take during its stroke.

At the first position of bar 13*a*, the second rotation element 12*b* is in a first angular position; at the second position of bar 13*a*, the second rotation element 12*b* is in a second angular position.

The angular difference between the first and second angular positions of the second rotation element 12*b* is advantageously smaller than or equal to 360°; this means that, by a single revolution of the second rotation element 12*b*, the bar 13*a* can be moved along all its stroke.

Obviously, in the light of the above, to a single rotation of the second rotation element 12*b* will correspond a plurality of rotations of the first rotation element 12*a* and, consequently, of the output shaft 11 of motor 10.

The electric motor 10 is interlocked with suitable drive means 14 regulating movement of motor 10 and the consequent displacements of bar 13*a*, according to preset work programs. The drive means 14 comprises a controller, provided with a memory 31 on which all information necessary to manufacture the desired textile product is stored.

In particular, with reference to motor 10 and the carrier slide bar 13*a*, the memory 31 of said controller contains a succession of command parameters (referred to as "numeric chain") to suitably move bar 13*a* at each weft row.

To control displacements of bar 13*a* during normal operation of the machine 200, the device 1 is provided with a single-revolution sensor 15*b* associated with an electronic processing block that, as long as the device 1 is powered, electronically implements a "multi-revolution" function, capable of univocally identifying the multi-revolution position of shaft 11, representative of the absolute position of the knitting member 13.

The single-revolution sensor 15*b*, obtained by a conventional encoder or a common resolver, has the task of detecting the angular position of the output shaft 11 of motor 10 and generating a corresponding second parameter 99; this detection is carried out with reference to the instantaneous position of shaft 11 within a rotation of 360°. This means that the second parameter 99 supplied by the single-revolution sensor 15*b* has a value included between 0° and 360° and identifies the instantaneous angular position of shaft 11 irrespective of the number of whole revolutions previously carried out.

The information made available by the single-revolution sensor 15*b* and said electronic processing block is sufficient for the drive means 14 to correctly regulate the displacements of bar 13*a* during operation of the machine 200; however, when the machine 200 and device 1 are de-energized, the electronic processing block is no longer able to operate and therefore cannot be employed for recognizing possible displacements of the knitting member 13 occurred with a turned-off machine.

The control device 1 is further provided with a multi-revolution sensor 15*a* associated with the shaft 11 of motor 10 to generate a first parameter 98; the latter indicates a whole number of revolutions carried out by the output shaft 11 to bring member 13, i.e. the weft bar 13*a*, to a given position.

Said single-revolution 15*b* and multi-revolution 15*a* sensors generally define detecting means 15 that in FIG. 1 is identified as a whole by reference numeral 15. The detecting means 15 is set to supply a main output parameter 100 representative of the position of the knitting member 13 and, in particular of the carrier slide bar 13*a*.

In more detail, the main parameter 100 gives an indication of the absolute position of the knitting member 13; in other words, the main parameter 100 univocally identifies the position taken by member 13.

With reference to the bar 13*a*, this means that the main parameter 100 univocally identifies the position of bar 13*a* within the bar stroke defined between said first and second positions; in other words the main parameter 100 is representative of the absolute position of the bar 13*a* within the bar stroke.

In the preferred embodiment of the invention, the main parameter 100 is the "multi-revolution" absolute angular position of the output shaft 11 of motor 10; the main parameter 100 therefore identifies not only the "single-revolution" angular position of shaft 11 within a single revolution, but the true rotation (even when exceeding 360°) that is carried out at a single displacement of member 13.

The detecting means 15 is further provided with a combination block 17 connected with said single-revolution 15*b* and multi-revolution 15*a* sensors to receive the first and second parameters 98, 99 therefrom; said parameters are combined with each other so as to obtain said main parameter 100.

Advantageously, the combination block 17 is defined by an adding circuit 17*a* summing up the first and second parameters 98, 99 to obtain the main parameter 100, as a result.

To allow the multi-revolution sensor 15*a* to operate in a correct manner, a second reduction gear 16 is provided to be interposed between shaft 11 and sensor 15*a*.

In the same manner as above described with reference to the first reduction gear 12, the second reduction gear 16 is provided with a first rotation element 16*a* fitted on a second end 11*b* of shaft 11, and with a second rotation element 16*b* connected with sensor 15*a*.

The first and second rotation elements 16*a*, 16*b* can for example consist of two gear wheels in mutual engagement, or two pulleys connected with each other by a driving belt.

The diameter of the first rotation element 16*a* is smaller than the diameter of the second rotation element 16*b*; the ratio between the diameter of the first rotation element 16*a* and the diameter of the second rotation element 16*b* defines the reduction ratio of the second reduction gear 16.

Advantageously, the reduction ratio of the second reduction gear 16 is included between 1/10 and 1/6 and is preferably equal to 1/8.

In the preferred embodiment of the invention, the reduction ratio of the first reduction gear 12 is greater than the reduction ratio of the second reduction gear 16, so that the sensor means 15 can detect the main parameter 100 in a precise manner.

It is to be noted that the second reduction gear 16 may also comprise further rotary elements, until reaching a total amount of four gear wheels suitably connected in succession, for example.

It will be recognized that, since reduction between the number of revolutions of shaft 11 and the second rotation element 16*b* is obtained in a completely mechanical manner (i.e. by means of said pulleys or gear wheels), the multi-revolution sensor 15*a* is able to correctly detect the absolute position of member 13 even when displacements of member 13 have occurred during turning off of the machine 200 and device 1.

The main parameter 100 is incorporated in a main signal 110 that is transmitted to the drive means 14, so that the latter may become acquainted with the absolute angular position of shaft 11 and, as a result, operate motor 10.

In more detail, the drive means 14 is provided with said memory 31 containing the command parameters for each weft row destined to bar 13*a*; in particular, an auxiliary parameter 101 is present in memory 31 that identifies the position taken by bar 13*a* at the moment that device 1 and machine 200 are deactivated.

The drive means 14 further comprises receiving means 30 to receive the main signal 110 from the detecting means 15; said main signal incorporates the main parameter 100 that can conveniently be representative of a starting position of bar 13*a*, i.e. the position taken up by bar 13*a* when the machine 200 and device 1 are activated again.

Said new activation is successive in time with respect to deactivation of the machine 200 and device 1.

A comparing circuit 33 is connected with memory 31 and the receiving means 30 to compare the main parameter 100 and auxiliary parameter 101 with each other; depending on this comparison, a transmission block 34 connected downstream of the comparing circuit 33, sends a corresponding command signal 120 to motor 10.

Obviously, the different operating blocks (receiving means 30; comparing circuit 33; transmission block 34) described with reference to the drive means 14 can consist of a single electronic device capable of performing the stated functions; separation into different blocks has been carried out exclusively for the purpose of clarifying the important aspects of the invention from a functional point of view.

As regards operation the following is to be pointed out.

When device 1 and the textile machine associated therewith are activated, device 1 generates command parameters for a controlled powering of motor 10 and consequent movement of the knitting member 13.

To suitably carry out this control, the drive means 14 takes advantage of the information supplied by the single-revolution sensor 15*b* and the numeric chains stored in memory 31.

When the textile machine 200 is deactivated (and device 1 therewith), in memory 31 a trace is maintained of the last command parameter sent to motor 10; this last command parameter is said auxiliary parameter and it identifies the position of bar 13*a* when deactivation of the system occurs.

When the machine and device 1 are activated again, the position of bar 13*a* can be different from the position taken up by said bar 13*a* when the machine 200 was turned off, due to manual displacements carried out in the period of deactivation of the machine 200 and device 1.

To detect possible variations in the position of bar 13*a*, first of all the position at which the bar 13*a* is, at the moment of new activation of the system, is detected; this position, identified by the main parameter 100, is detected by the detecting means 15 and sent to the drive means 14 through the main signal 110.

In more detail, the single-revolution sensor 15*b* detects the absolute angular position of the output shaft 11 and generates the corresponding second parameter 99; the multi-revolution sensor 15*a* on the contrary detects the (whole) number of revolutions required to bring the bar 13*a* to the position where it is at the moment of activation of the system and generates the corresponding first parameter 98.

The adding circuit 17*a* carries out the sum of the first and second parameters 98, 99, to obtain the main parameter 100.

The comparing circuit 33 carries out a comparison between the main parameter 100 and auxiliary parameter 101. Practically, therefore, the comparing circuit 33 carries out a comparison between the position where the bar 13*a* is at the moment of a new activation and the position where the bar 13*a* was when the system was deactivated.

Should the two parameters be substantially equal, the bar 13*a* practically would not move and no correcting operation would be required; if, on the contrary, an important difference is detected between the main parameter 100 and auxiliary parameter 101, the presence of an abnormal condition is signaled to the operator, through a message viewed on a display for example or on equivalent displaying means, associated with the drive means 14.

Following an enable signal inputted by the user, the transmission block 34 sends a command signal 120 to motor 10, to bring the bar 13*a* back to the position identified by the auxiliary parameter 101, i.e. the position that was taken by the bar 13*a* before deactivation of the machine 200 and device 1.

For the purpose, the command signal 120 incorporates a displacement command destined to motor 10, to cause the latter to bring the output shaft 11 back to the position identified by the auxiliary parameter 101, i.e. the absolute angular position at which shaft 11 was before the system were deactivated.

The invention achieves important advantages.

First of all, the device in accordance with the present invention allows one or more members of the textile machine with which the device itself is associated to be displaced when the machine is deactivated, without the occurrence of problems, failures or malfunctions at the moment of new activation of the machine itself.

In particular, by virtue of the above, maintenance and cleaning operations can be carried out when the machine is at a standstill without impairing the machine devices or possible semifinished products in engagement with said devices when the machine is turned on again.

In addition, by use of the first reduction gear 12, the dynamic features of motor 10 are exploited to the best, allowing said motor to supply a higher torque while at the same time improving accuracy and liability in the movements of the knitting member 13.

What is claimed is:

1. A control device for textile machines, in particular crochet machines, comprising:

an electric motor (10) having an output shaft (11) drivable in rotation;

a first reduction gear (12) interposed between said output shaft (11) and a knitting member (13) of a textile machine;

drive means (14) for powering and controlling said motor (10);

detecting means (15) to detect a main parameter (100) representative of a position of said knitting member (13) and generate a corresponding main signal (110) incorporating said main parameter (100) and destined to said drive means (14), said means regulating power supply to said motor (10) depending on said main parameter (100).

2. The device as claimed in claim 1, wherein said main parameter (100) is representative of an absolute position of said knitting member (13).

3. The device as claimed in claim 1, wherein said main parameter (100) is an absolute angular multi-revolution position of said output shaft (11).

4. The device as claimed in claim 2, wherein said detecting means (15) comprises a multi-revolution sensor (15*a*) associated with the output shaft (11) of said motor (10) to generate a first parameter (89) representative of a whole number of revolutions carried out by said shaft (11) to bring said member (13) to said absolute position.

5. The device as claimed in claim 4, further comprising a second reduction gear (16) interposed between said output shaft (11) and multi-revolution sensor (15*a*), said second reduction gear (16) having a reduction ratio greater than or equal to a reduction ratio of said first reduction gear (12).

6. The device as claimed in claim 1, characterized in that said knitting member (13) is a carrier slide bar (13*a*) movable between a first and at least one second position, said first and second positions defining a first and second ends respectively of a stroke of said carrier slide bar (13*a*) along a direction substantially parallel to a longitudinal extension thereof, said main parameter (100) being representative of an absolute position of said bar (13*a*) within said stroke.

7. The device as claimed in claim 6, wherein said first reduction gear (12) comprises:

a first rotation element (12*a*) connected with the output shaft (11) of said electric motor (10);

a second rotation element (12*b*), in engagement with said first rotation element (12*a*) and connected with said bar (13*a*) to move the latter in a direction substantially parallel to the longitudinal extension thereof, said second rotation element (12*b*) being movable in rotation between a first angular position, at which said bar (13*a*) is in its first position, and a second angular position, at which said bar (13*a*) is in its second position, the angular difference between said first and second angular positions being smaller than or equal to 360°.

8. The device as claimed in claim 4, wherein said detecting means (15) further comprises a single-revolution sensor (15*b*) to generate a second parameter (99) representative of an absolute angular position of said output shaft (11).

9. The device as claimed in claim 8, wherein said detecting means (15) further comprises a combination block (17) connected with said single-revolution (15*b*) and multi-revolution (15*a*) sensors to receive said first and second parameters (98, 99) and obtain said main parameter (100).

10. The device as claimed in claim 6, wherein said drive means (14) comprises:

a memory (31) to store at least one auxiliary parameter (101) representative of a final position of the bar (13*a*) before deactivation of the device (1);

receiving means (30) to receive said main signal (110) from said detecting means (15), said main parameter (100) being representative of a starting position of said bar (13*a*) corresponding to an activation of said device (1) subsequent to said deactivation;

a comparing circuit (33) connected with said receiving means (30) and memory (31) to compare said main and auxiliary parameters (100, 101) with each other;

a transmission block (34) connected with said comparing circuit (33) to generate, depending on said comparison, a command signal (120) destined to said motor (10), when said main and auxiliary parameters (100, 101) are substantially different from each other.

11. The device as claimed in claim 10, wherein said command signal (120) incorporates a displacement command for said motor (10) to move the output shaft (11) to the angular position identified by said main parameter (100).

12. The device as claimed in claim 1, further comprising an auxiliary sensor (300) to detect at least one angular position (PA) of a main shaft (301) of the machine (200), said auxiliary sensor (300) being connected with said drive means (14) to transmit said angular position (PA) thereto, said drive means (14) being adapted to generate a synchronism signal (302) for said knitting member (13) to move the same depending on said angular position (PA) and on a predetermined program.

13. The textile machine, in particular a crochet machine, comprising:

at least one knitting member (13), for manufacture of a textile product;

a control device (1) as claimed in claim 1.

* * * * *